United States Patent [19]

Giebel

[11] Patent Number: 4,480,778

[45] Date of Patent: Nov. 6, 1984

[54] HEEL NAILING MACHINE

[75] Inventor: Gerhard Giebel, Bod Soden, Fed. Rep. of Germany

[73] Assignee: USM Corporation, Farmington, Conn.

[21] Appl. No.: 415,576

[22] Filed: Sep. 7, 1982

[30] Foreign Application Priority Data

Sep. 7, 1981 [DE] Fed. Rep. of Germany ..... 3135358

[51] Int. Cl.[3] ..... B27F 9/00; A43D 43/00; A43D 95/04

[52] U.S. Cl. ..... 227/40; 12/42 R; 12/42 B; 227/28; 227/29

[58] Field of Search ..... 12/42 R, 42 B, 42.5, 12/43, 43.5; 227/28, 29, 40, 41, 152

[56] References Cited

U.S. PATENT DOCUMENTS

| | | | |
|---|---|---|---|
| 561,608 | 6/1896 | Raymond | 227/28 |
| 674,806 | 5/1907 | Woods | 227/40 |
| 1,346,248 | 7/1920 | Pope | 12/42 R |
| 1,366,935 | 2/1921 | Reardon | 12/42 B |
| 1,399,784 | 12/1921 | Mayo | 227/29 |
| 2,324,479 | 7/1943 | Brandt | 12/42 R |
| 2,943,329 | 7/1960 | Spencer | 12/42 B |

*Primary Examiner*—Paul A. Bell
*Attorney, Agent, or Firm*—Donald N. Halgren

[57] ABSTRACT

A heel nailing machine having a holddown for the heel which clamps the heel against movement during attachment. The holddown is then moved upwards to lift the heel and attached shoe off the stand. The holddown then swings to one side and the shoe is released. The shoe is thus automatically ejected from the machine.

2 Claims, 4 Drawing Figures

HEEL NAILING MACHINE

BACKGROUND OF THE INVENTION

1. Field of the Invention

The invention is concerned with an apparatus for nailing heels onto shoe uppers fitted with insole, in which the shoe upper is positioned on a nailing stand and a holddown presses the heel onto the nailing stand while gripped laterally by holding elements.

2. Prior Art

An apparatus of this kind is represented in perspective view in FIG. 1 DE No. 22 57 088. For the nailing on of a heel, a heelless shoe upper is placed on the nailing stand of this apparatus and thereupon the heel to be nailed on is positioned on the shoe upper. These operations are carried out by hand. The holddown thereof being at first in the rest position is then moved downwards out of this above-the-heel rest position of the apparatus and presses the heel onto the shoe upper, whereby heel and shoe upper are held in a defined position by means of the holddown and the nailing stand. Then there follows the nailing process through the nailing stand, in which drivers arranged in the nailing stand drive in the nails, which were previously positioned automatically above the drivers, in the substantially vertical direction upwards through the insole into the heel, whereby the heel is fixed onto the shoe upper. The holddown is then moved away from the heel by an upwards movement whereby the shoe upper with heel is released and can be taken off the nailing stand by hand.

BRIEF SUMMARY OF THE INVENTION

The present invention underlies the task of making automatic the process of the removal of the shoe upper with nailed-on heel. This takes place according to the invention in that the holding elements are provided with a clamping arrangement pressing them together and the holddown can be pivoted sideways from the axis of the nailing stand wherein with the clamping arrangement (32, 50) operated, the holddown is raised taking with it the heel complete with shoe upper and then is swung in such a manner that upon release of the clamping arrangement in the swung position the shoe upper complete with heel drops down by the side of the nailing stand.

Because the clamping arrangement may press together the holding elements, it is possible to hold the heel concerned so firmly, that the latter together with the shoe upper can be lifted up after the nailing process of the nailing stand so that, in the raised position, the shoe upper which is free of the nailing stand can be moved out of the area of the nailing stand through the swinging of the holddown. Through release of the clamping arrangement in this position, the shoe upper with the heel is then released and drops down by the side of the nailing stand, in particular into an already-positioned catching basket. For the operator, the advantage results there that he can let go of the shoe upper positioned on the nailing stand after the gripping of the heel by the holding elements before the nailing process. The operator can then, in the time period of the nailing process and the raising and swinging of the shoe upper with heel, take out the formerly nailed shoe from the catching bowl and otherwise dispose of it. At the disposal position concerned, it can be acted on by a conveyor belt that also carries thereto the shoe uppers to be worked on. Through the described movement process, an arrived but still unworked-on shoe upper can be taken off the conveyor belt and the apparatus supplied for manufacture. Thereby the holddown in the swung position takes effect favorably insofar as it allows the operator a relatively great free period for the positioning of the unworked-on shoe upper and the heel, so that he can easily bring about the necessary alignment of the shoe upper and the heel in this free period. The raising of the holddown together with the heel and the shoe upper attached thereto from the nailing stand is easily accomplished before the raising process so that the holddown goes through a different movement in the substantially parallel direction to the longitudinal axis of the shoe, and indeed in such a direction that thereby the heel part of the shoe upper is spaced a few millimeters from the nailing stand. This heel part is designed concave so that in the raising it can be held firmly against the necessary existing corresponding camber of the nailing stand. The heel of the shoe upper must in such a case correspondingly deform through the elasticity of the shoe material. The displacement process avoids this, through which eventual impairments of shoe material are avoided.

BRIEF DESCRIPTION OF THE DRAWINGS

The objects and advantages of the present invention will become more apparent when viewed in conjunction with the following drawings in which.

DESCRIPTION OF THE PREFERRED EMBODIMENT

Figure 1:
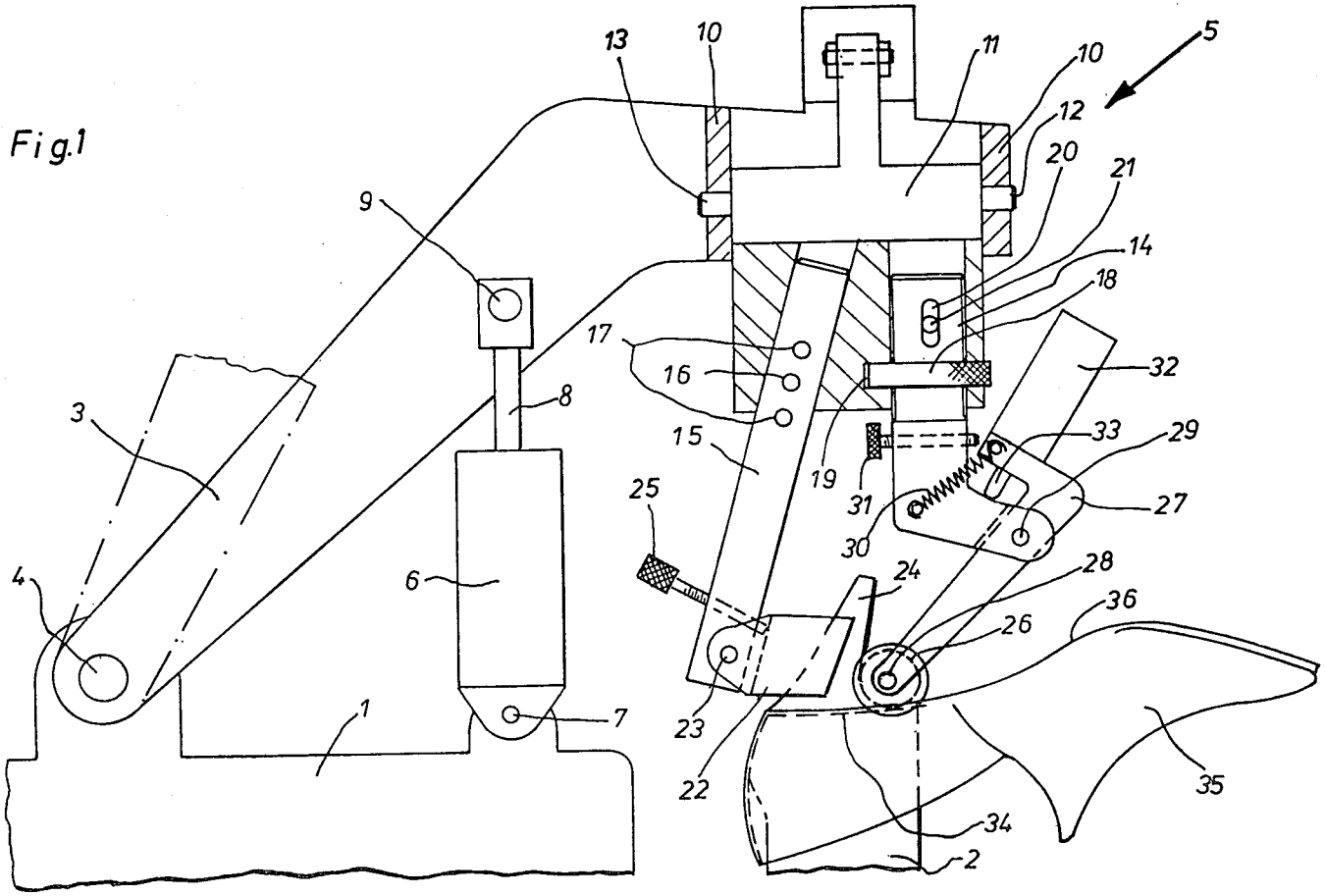
FIG. 1 shows the apparatus in side view with a holddown in registration with the thin heel of a ladies shoe.

The apparatus represented in FIG. 1 shows in cross-section only, those parts which are of importance for the understanding of the invention. Reference is made to the above-mentioned state of the art which shows the already previously known components of such an apparatus. FIG. 1 shows the frame 1 of the apparatus with the bottom broken away, also the upper end of the nailing stand 2 which is likewise shown broken away. The carrying arm 3 which carries the holddown 5 is pivoted on the frame 1 on the link 4. The carrying arm 3 makes a straight upwards and downwards movement with its holddown 5 carrying end, which movement is brought about by the piston-cylinder-unit 6. The piston-cylinder-unit 6 is at one end pivoted on the link 7 on the frame, at the other end its piston 8 acts on the link 9 on the carrying arm 3 and lifts this up, repsectively lowers it.

On the receiver 10 shown in cross-section on the end of the carrying arm 3, the swinging part 11, also shown in cross-section, is arranged as fixed part of the holddown 5, which part is mounted turnably in the receiver 10 and indeed by means of the stub axles 12 and 13 which are carried in corresponding bores of the receiver 10. The gripping holders 14 and 15 are mounted in the swinging part 11. Therein the gripping holder 15 is locked relative to the swinging part 11 by means of the pin 16. The gripping holder 15 is provided with several bores 17 so that the gripping holder 15 can be set in different positions in the swinging part 11 and moved relative thereto. The gripping holder 14 is put into the swinging part 11 and locked relative to the swinging part by means of the knurled nut 18. The knurled nut 18 is in a corresponding slit 19 in the swinging part so that by turning the knurled nut 18, in which a winding formed on the gripping holder 14 engages the gripping holder 14 can be pulled out of the swinging part or respectively into the latter. The gripping holder 14 is provided with the longitudinal hole 20, in which the pin 21, which is fixed into the swinging part 11, engages so that the gripping holder 14 is secured in this manner against rotation. The holding element 22 is turnably pivoted on the gripping holder 15 on the link 23, that adapts itself with its shape to the shape of the heel 24. So that the gripping element 22 cannot turn itself too far upwardly through pressure of the heel 24, the stop screw 25 is provided. On the side of the heel 24 lying opposite the holding element 22, the roll 26 is provided designed as further holding elements, which is turnably mounted on the angled lever 27 by means of the axle 28. The angled lever 27 is pivoted on the axle 29 which is mounted on the end of the gripping holder 14 which projects out of swinging part. The tension spring 30 hung on the one side, on the gripping holder 14 and, on the other side, on the angled lever 27 provides that the angled lever 27 is given such a tension that the roll 26 has the tendency to move away from the heel. This movement is limited by the adjusting screw 31 which serves as a stop. In the end position of the angled lever 27 defined by the adjusting screw 31, the roll 26 is so far distant from the heel 24 that the heel 24 can be inserted in an unhindered manner between the holding element 22 and the roll 26.

On the angled lever 27 is mounted, furthermore, the piston-cylinder-unit 32, serving as gripping arrangement, which presses with its plunger 33 against the angled end of the gripping holder 14 and hereby swings the angled lever 27 about the axle 29 in such a manner that the roll 26 is pressed against the heel 24 whereby the latter presses for its part against the holding element 22. The piston-cylinder-unit 32 acting as gripping arrangement therefore provides that by its action the heel 24 is gripped firmly between the holding element 22 and the roll 26 acting as the opposite lying holding element, whereby this gripping acts so that the heel 24 is firmly held.

Figure 2:
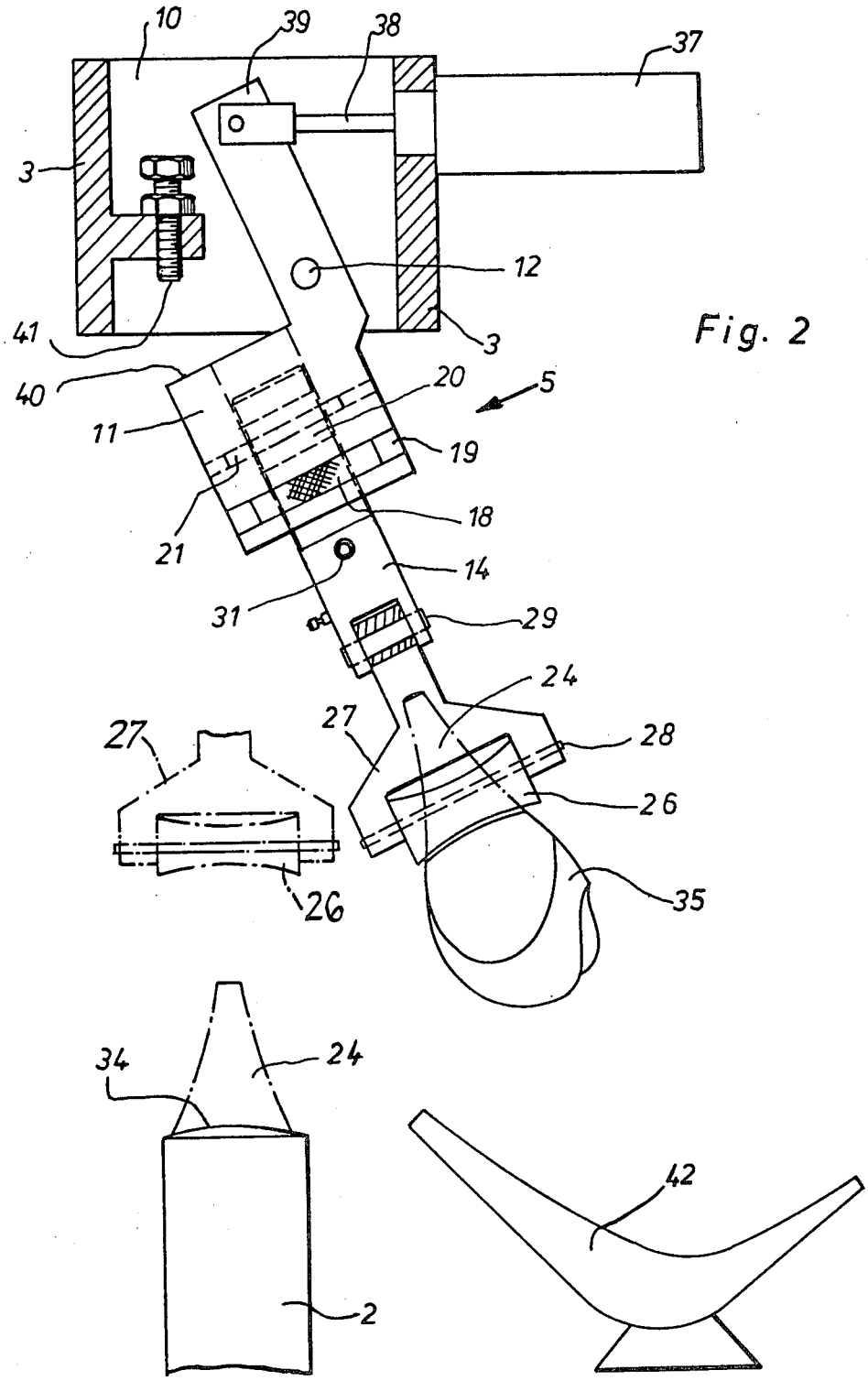
FIG. 2 shows the same apparatus in front view with swung holddown.

As already mentioned above, the holddown 5 can be swung about the stub axles 12 and 13 with its part fixed on the swinging part. In FIG. 2, the holddown 5 is represented in the swung position. The carrying arm 3 shown in FIG. 2 in cross-section is shown in a after-upwards-swinging position indicated in dashed line in FIG. 1, whereby only the part of the carrying arm 3 positioned on the link 4 is shown in dashed line. In this raised position of the swinging arm 3, the holding elements 22 and the roll 26 are at such an interval from the carrying surface 34 of the nailing stand 2 that the carrying surface 34 is free, apart from this the unhindered access to the carrying surface 34 is additionally made easy in that the holddown 5 according to FIG. 2 is in the swung position. In the position represented in FIG. 2, a shoe upper, as it is supplied in FIG. 3 with the reference number 35, can be positioned on the carrying surface 34 in an unhindered manner, after which the heel 24 is then positioned on the insole of the shoe upper 35. The holddown 5 is then swung back, through an operation, known in this context, of a control in the apparatus, from its swung position represented in FIG. 2 into the position indicated in dashed line in FIG. 2, in which the holding element 22 and the roll 26 are in a high position above the heel 24 likewise shown in dashed line in FIG. 2. The carrying arm 3 is then moved down through a corresponding movement of the piston-cylinder-unit 6 whereby the holding element 22, as represented in FIG. 1, places itself against the near surface of the heel 24 and the roll 26 rolls along the sole 36 of the shoe upper until the roll 26 arrives in the overhang of the front surface of the heel 24 over the sole 36. Through the operation of the piston rod 8 of the piston-cylinder-unit 6, the carrying arm, and with it the holddown 5, is pressed down so that, in consideration of the oblique position of the angled lever 24, and the roll 26 secures a firm contact between the heel 24 and the holding element 22 on the one side and the roll 26 on the other side. In this position of the carrying arm 3, the latter is then held firmly by locking means not shown. The nailing of the heel 24 then follows in known manner through the nailing stand 2 whereby the heel is firmly united with the shoe upper 35.

Now (if need be also before the nailing operation) the (omitted from FIG. 2 in the interest of clarity) piston-cylinder-unit 32 acting as gripping arrangement is effective, which unit presses with its plunger 33 on the angled end of the gripping holder 14 and thereby tries to swing the angled lever 27 further about its axle 29. The result thereof is a pressure of the roll 26 against the heel 24 and thereby against the holding element 22 whereby the action of the tension spring 30 is compensated for. Holding element 22 and roll 26 are thereby in a position held upright by the piston-cylinder-unit 32, in which they firmly grip the heel. Now the piston-cylinder-unit 6 acts in such a manner that its piston rod 8 is moved out whereby the carrying arm 3 is swung upwards about its link 4. The carrying arm 3 raises with it the holddown 5 from the nailing stand 2 whereby, through the above described firm gripping of the heel 24 by the holding element 22 and the roll 26, the heel 24 and with it the shoe upper 35 attached thereto is raised. The roll 26 eventually takes up the position indicated in dashed line in FIG. 2, in which the shoe upper 35 is completely clear of the nailing stand 2 so that now the holddown 5 with its construction parts can be moved over into the swung position represented in FIG. 2. This swinging is effected by means of the piston-cylinder-unit 37 which is fixed on the carrying arm 3 and by means of its piston rod 38 pressing on the lever arm 39 on the swinging part 11. The swinging part 11 is thereby, as above described, swung about the stub axles 12 and 13. In order to swing the holddown 5 back into its vertical position in which the roll 26 is in the position shown in dashed line in FIG. 2, the piston-cylinder-unit 37 operates in reverse direction whereby the lever arm 39 is pulled back out of the position shown in FIG. 2 until eventually the swinging part 11 engages the adjustment screw 41, which serves as a stop, with its stop surface 40.

In FIG. 2, the position of a shoe upper 35 with heel 24 attached thereto is also shown, which upper is held in the swung position by the holddown 5. The shoe upper 35 thereby is in such a position that it can freely fall down next to the nailing stand 2 through release of the piston-cylinder-unit 32 serving as gripping arrangement. Through this release of the piston-cylinder-unit 32, the tension spring 30 becomes effective again, which spring moreover turns the angled lever 27 about the axle 29 in such a manner that the roll 26 releases the heel 24 which thereupon can move freely downwards between the now spaced from the heel 24 roll 26 and the holding element 22 and is caught by the catching bowl 42.

With the apparatus represented in FIGS. 1 and 2, it is a question of operation on slim heels for ladies' shoes. It is also possible to so design the apparatus so that is can operate on block heels.

Figure 3:
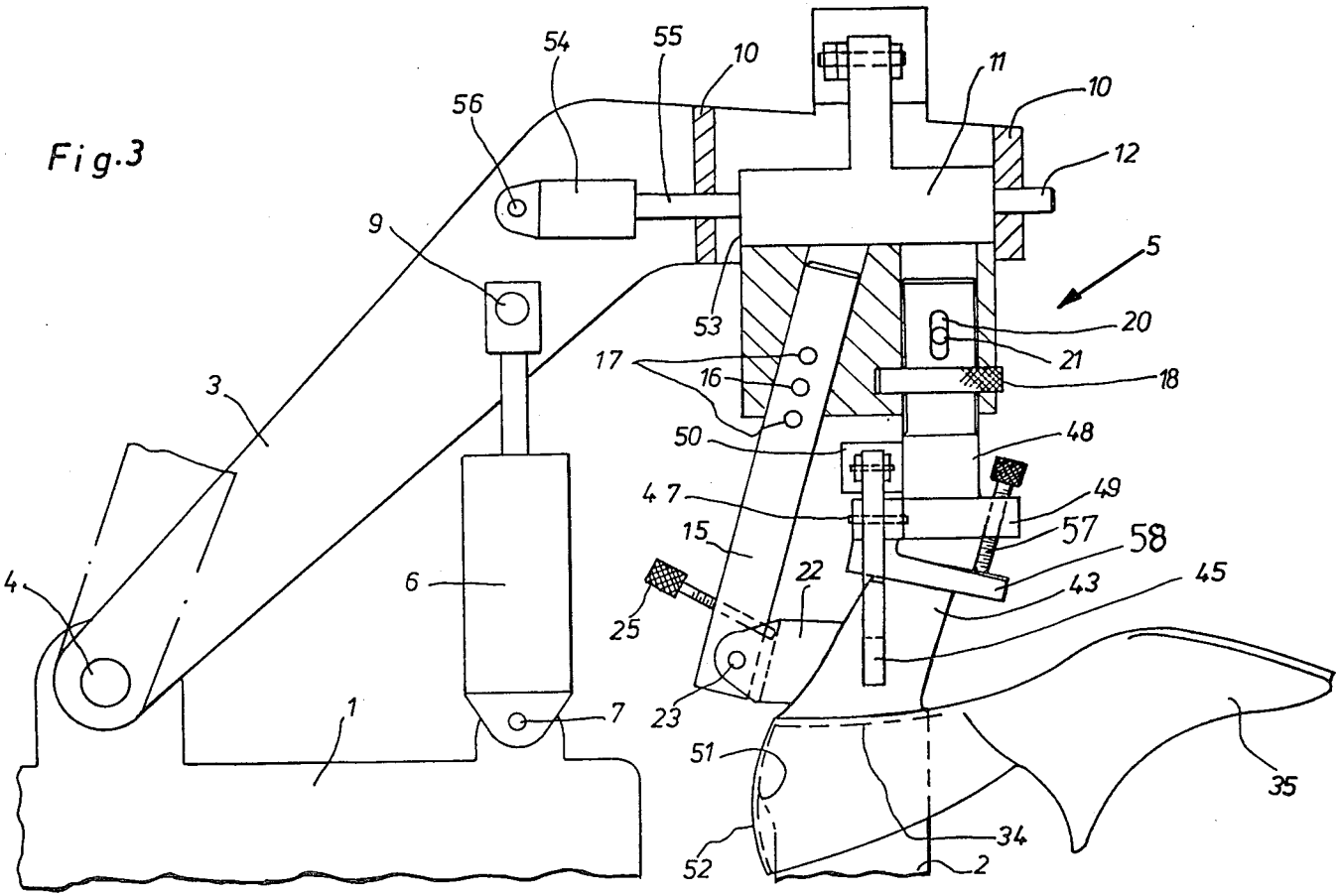
FIG. 3 shows a modification of the apparatus according to FIG. 1 with a holddown in registration with a block heel in side view.
Figure 4:
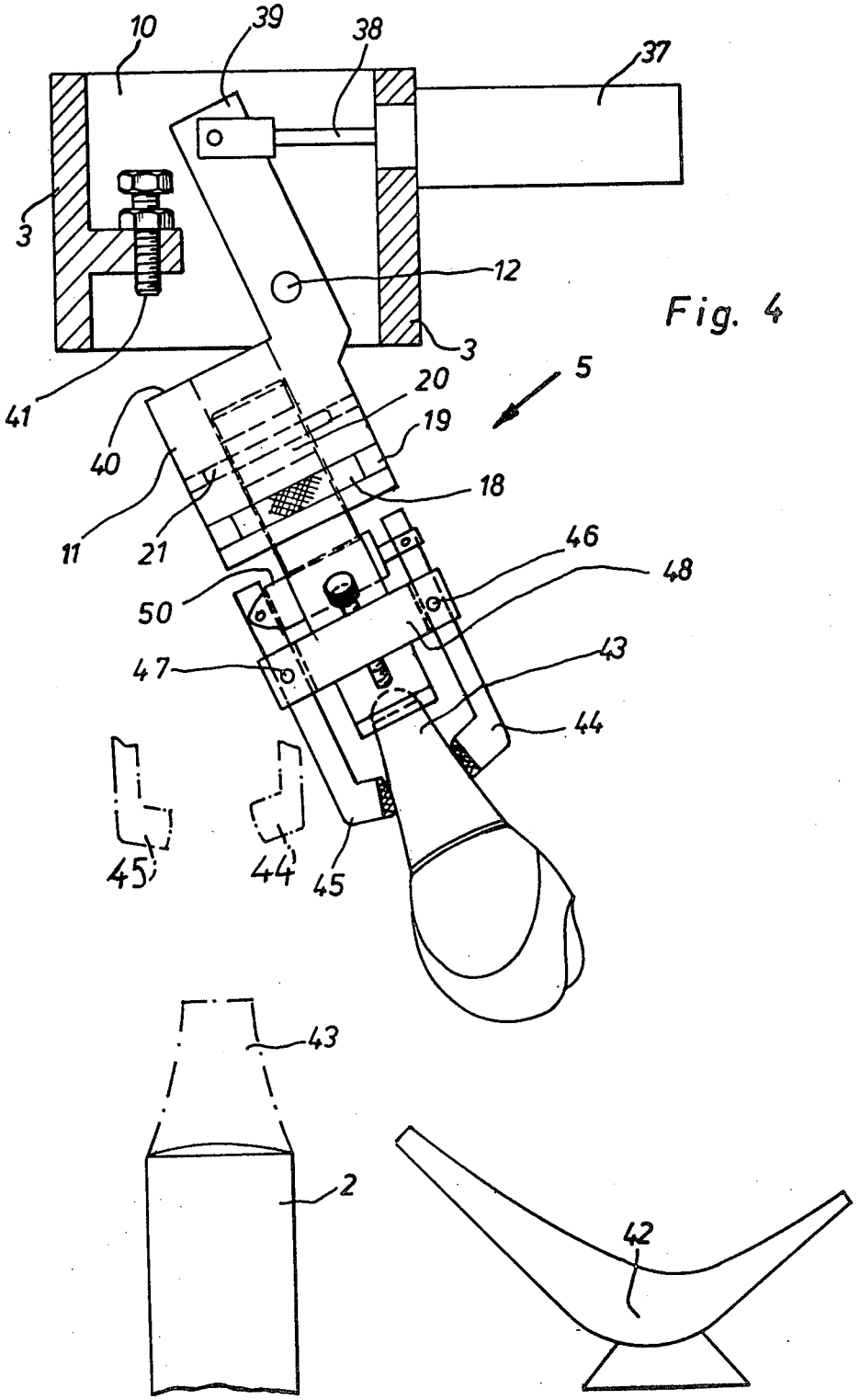
FIG. 4, the apparatus is shown according to FIG. 3 in front view with swung holddown.

Such an apparatus is represented in FIGS. 3 and 4, which largely corresponds to FIGS. 1 and 2 so that with regard to the individual construction parts and the functions the description of FIGS. 1 and 2 can be referred to. In the difference of the apparatus according to FIGS. 1 and 2, the holding elements are so designed for the gripping of the heel that block heels, such as the block heel 43 can also be firmly held. The holding elements here consist of the gripping jaws 44 and 45 which engage the block heel 43 like tongs. The two gripping jaws 44 and 45 are mounted on the axles 46 and 47 which fixed on the gripping holder 48. The gripping holder 48 is for this purpose provided with the crosspiece 49 on its end which extends out of the swinging part 11, in which crosspiece the axles 46 and 47 are set and which embraces the gripping jaws 44 and 45 respectively like a fork. The piston-cylinder-unit 50 serving as gripping arrangements acts on the gripping jaws 44 and 45 on the ends thereof opposite to the heel 43, which unit by its operation in the one direction presses the gripping jaws 44 and 45 about the axles 46 and 47 against the block heel 43 and by other-direction-operation removes the gripping jaws 44 and 45 from the heel 43. The operation of the piston-cylinder-unit 50 takes place in corresponding manner to that of the piston-cylinder-unit 32 according to FIG. 1 so that therefore in the functional operation of the apparatus according to FIGS. 3 and 4 the same individual steps result as from the functional operation of the apparatus according to FIGS. 1 and 2.

The apparatus according to FIGS. 3 and 4 is additionally with a further movement mechanism for the holddown 5, which allows the holddown 5 to move in the direction substantially parallel to the longitudinal axis of the shoe upper 35. In FIG. 3, the apparatus is shown in its position in which the nailing operation takes place. When now after nailing has taken place, the shoe upper 35 together with the block heel 43 is raised up from the nailing stand 2, then, as explained at the beginning, the camber 51 of the nailing stand 2 can have a hindering effect as the shoe upper 35 with its heel 52 must be moved away over the camber 51. This away movement is made easy in that the holddown 5 according to the illustration in FIG. 3 is shifted from right to left, that is, movable by drive means along a path substantially parallel to the longitudinal axis of the shoe on the nail stand 2. In addition, the stub axles 12 and 13 slide in the corresponding bores of the receiver 10 for the length which is left free between the face side 53 of the swinging part 11 and the receiver 10. This movement is actuated by the drive means such as a piston-cylinder-unit 54, which with its piston rod 55 joins the stub axle 13 and is fixed on the carrying arm 3 at its opposite side to the piston rod by means of the bolt 56. Through the operation of the piston-cylinder-unit 54 can, therefore, the swinging part 11 and with it the constructional parts mounted thereon execute to and fro movement limited by the face side 53 of the swinging part 11 and the corresponding wall of the receiver 10. Through the movement of the swinging part 11 out of the position shown in FIG. 3 into the not-shown rearward position, such a gap is created between the camber 51 and the inner side of the heel 52 that the shoe upper 35 can be lifted up from the nailing stand 2 without further ado. This movement of the swinging part 11 therefore takes place before the shoe upper is raised from the nailing stand 2 in the above described manner. If need be, one can on the grounds of time combine the movement of the swinging part 11 with the raising of the holddown 5.

I claim:

1. A machine for nailing heels on the shoe uppers fitted with insole, in which the shoe upper is positioned on a nailing stand and a holddown presses the heel onto the shoe upper on the nailing stand while being gripped laterally by an arrangement of holding elements, wherein said holding elements are provided with a clamping arrangement for pressing the upper and the heel together, the holddown being pivotable sideways from the axis of said nailing stand wherein said clamping arrangement is operable to raise a heel complete with its attached shoe upper from said stand and to swing it in such a matter that upon release of the clamping arrangement in the swung position a shoe upper complete with its heel may be dropped down by the side of said nailing stand.

2. A machine as recited in claim 1, where said holddown is moveable by drive means along a path substantially parallel to the longitudinal axis of the shoe.

* * * * *